US006484516B1

(12) United States Patent
Agrawal et al.

(10) Patent No.: US 6,484,516 B1
(45) Date of Patent: Nov. 26, 2002

(54) METHOD AND SYSTEM FOR CRYOGENIC REFRIGERATION

(75) Inventors: Rakesh Agrawal, Emmaus, PA (US); Zbigniew Tadeusz Fidowski, Macungie, PA (US); Donn Michael Herron, Fogelsville, PA (US); William Curtis Kottke, Fogelsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/010,171

(22) Filed: Dec. 7, 2001

(51) Int. Cl.[7] ..... F25B 9/00; F25D 9/00
(52) U.S. Cl. ..... 62/26; 62/401
(58) Field of Search ..... 62/498, 467, 401, 62/402, 86, 612, 613

(56) References Cited

U.S. PATENT DOCUMENTS

| | | | | | |
|---|---|---|---|---|---|
| 2,575,589 | A | * | 11/1951 | Horn | 132/210 |
| 3,964,891 | A | * | 6/1976 | Krieger | 62/335 |
| 4,143,520 | A | | 3/1979 | Zimmerman | |
| 4,161,107 | A | * | 7/1979 | Korsakov-Bogatkov et al. | 505/899 |
| 4,169,361 | A | * | 10/1979 | Baldus | 138/40 |
| 4,267,701 | A | * | 5/1981 | Toscano | 62/402 |
| 4,498,313 | A | * | 2/1985 | Hosoyama et al. | 505/894 |
| 4,599,866 | A | | 7/1986 | Nakagome et al. | |
| 4,611,474 | A | | 9/1986 | Musinksi | |
| 4,782,671 | A | | 11/1988 | Breneman et al. | |
| 4,858,442 | A | | 8/1989 | Stetson | |
| 4,926,646 | A | | 5/1990 | Dorri | |
| 4,953,366 | A | | 9/1990 | Swift et al. | |
| 4,979,368 | A | | 12/1990 | Stetson | |
| 5,022,229 | A | | 6/1991 | Vitale | |
| 5,172,554 | A | | 12/1992 | Swift et al. | |
| 5,275,002 | A | | 1/1994 | Inoue et al. | |
| 5,333,460 | A | | 8/1994 | Lewis et al. | |
| 5,396,206 | A | | 3/1995 | Herd et al. | |
| 5,442,928 | A | | 8/1995 | Laskaris et al. | |
| 5,457,956 | A | | 10/1995 | Bowman | |
| 5,461,873 | A | | 10/1995 | Longsworth | |
| 5,477,686 | A | | 12/1995 | Minas | |
| 5,485,730 | A | | 1/1996 | Herd | |
| 5,613,367 | A | | 3/1997 | Chen | |
| 5,623,240 | A | | 4/1997 | Sakuraba et al. | |
| 5,689,959 | A | | 11/1997 | Yatsuzuka et al. | |
| 5,701,744 | A | | 12/1997 | Eckels | |
| 5,711,156 | A | | 1/1998 | Matsui et al. | |
| 5,718,116 | A | * | 2/1998 | Grassi et al. | 62/402 |
| 5,749,226 | A | | 5/1998 | Bowman et al. | |
| 5,782,095 | A | | 7/1998 | Chen | |
| 5,848,532 | A | | 12/1998 | Gamble et al. | |
| 5,904,046 | A | | 5/1999 | Kawano | |
| 594,179 | A | | 8/1999 | Bowman et al. | |
| 5,966,942 | A | | 10/1999 | Mitchelll | |
| 6,041,620 | A | * | 3/2000 | Olszewski et al. | 62/612 |
| 6,094,921 | A | | 8/2000 | Zhu et al. | |
| 6,167,707 | B1 | | 1/2001 | Price et al. | |

* cited by examiner

*Primary Examiner*—William C. Doerrler
(74) *Attorney, Agent, or Firm*—Willard Jones, II

(57) ABSTRACT

A cryocooler system comprising a heat exchanger for cooling a compressed returning warmed cryogenic fluid stream, the heat exchanger having a bypass loop to produce a major stream and a minor stream exiting the heat exchanger. The minor stream is further cooled by expansion and used as a heat exchange medium for an external heat load after which it is compressed and returned to the heat exchanger for heat exchange with the compressed return warmed cryogenic fluid stream. The major stream is further cooled by expansion and recirculated to the heat exchanger to cool the compressed returning warmed cryogenic fluid stream. The major stream and minor stream are combined either inside or outside of said heat exchanger to form the warmed cryogenic fluid inlet stream for compression.

27 Claims, 4 Drawing Sheets

METHOD AND SYSTEM FOR CRYOGENIC REFRIGERATION

BACKGROUND OF THE INVENTION

This invention relates generally to refrigeration and more specifically to cryogenic refrigeration systems.

Cryogenic refrigerators, also known generally as cryocoolers, are needed to create refrigeration for superconductors, power transformers, magnetic resonance imaging, cryo surgery, and other cryogenic applications. There exist several known ways of supplying refrigeration at cryogenic temperatures.

One such technique involves the use of pulse tube refrigerators. U.S. Pat. No. 4,953,366 discloses an acoustic cryocooler formed from a thermoacoustic driver driving a pulse tube refrigerator through a standing wave tube. Pulse tubes, generally, are well known to those skilled in the art. A conventional pulse tube refrigerator uses a compression space, a radiator, an accumulator and a pulse tube arranged in series so as to constitute a closed operating space. Within the system there is a certain amount of operating fluid, such as helium gas, the pressure of which varies during operation of the device during compression and decompression. This varying pressure leads to the establishment of a phase difference between the pressure vibration and the displacement vibration of the operating fluid, which in turn leads to heat absorption at a lower temperature terminal.

The pulse tube refrigerator disclosed in the '366 patent includes a pulse tube, a first heat exchanger adjacent the pulse tube for inputting heat from a thermal load for cooling, and a second heat exchanger for removing heat transferred from the first heat exchanger across the pulse tube. Typically, the advantage to a pulse tube refrigerator is its lack of moving parts. Disadvantages include, however, relatively limited power and high specific power required to generate the (limited) refrigeration.

Additional known patents which cover variations of the pulse tube refrigerator include U.S. Pat. No. 5,275,002 to Inoue et al., U.S. Pat. No. 5,689,959 to Yatsuzuka et al., U.S. Pat. No. 5,711,156 to Matsui et al., U.S. Pat. No. 5,904,046 to Kawano, U.S. Pat. No. 5,966,942 to Mitchell, and U.S. Pat. No. 6,094,921 to Zhu et al.

A second known refrigeration device is commonly known as a Stirling machine and there are known variants related thereto. These too are generally well known to those skilled in the art. U.S. Pat. No. 4,143,520 to Zimmerman discloses, for example, a split Stirling machine. The split Stirling machine includes a displacer which fits loosely in a cylinder, with the cylinder connected to a piston chamber in which a piston is placed. The displacer interacts mechanically with the piston. When the displacer is in its lowest position, the piston is moved to its extreme compression position where it compresses the working fluid (typically helium gas) which thereby generates heat. As the displacer is then moved to the top of its cylinder, the warmed fluid in the displacer cylinder moves from the top of the cylinder to the bottom, with the bottom of the cylinder being at a lower temperature before the warmed fluid passes into this lower region of the displacement cylinder. After the warmed fluid moves into the lower region of the displacement cylinder, the piston is them moved to its extreme decompressed position, cooling the working fluid within the system. Then, when the displacer is moved back to its lowest position again, the cooled fluid is moved back to the top of the displacement cylinder, thereby completing the cycle.

Other patents known which purport to take advantage of the Stirling machine include U.S. Pat. No. 5,022,229 to Vitale, U.S. Pat. No. 5,477,686 to Minas, and U.S. Pat. No. 5,333,460 to Lewis et al. Generally, these devices create more refrigeration at a reasonable specific power, but have more moving parts as compared to the pulse tube refrigerators discussed above.

Some attempts have been made to join the pulse tube refrigerator technology with the Stirling cycle. U.S. Pat. No. 6,167,707 to Price et al. discloses a hybrid two stage expander having a first stage pulse tube expander. A common reciprocating compressor pneumatically drives both stages. The first stage Stirling expander purportedly provides high thermodynamic efficiency that removes a majority of the heat load from a gas within the cryocooler. The second stage pulse tube expander provides additional refrigeration capacity. The use of this system has the combined on drawbacks discussed above individually for each type of cryocooler.

Another group of cryocoolers has been developed specifically to cool superconductive magnets. These include baths in fluid cryogens, systems involving compression and expansion, cryogens with rare earth displacement materials used in regenerators, apparatuses to recondense vaporized helium, and hybrid systems. Several U.S. patents have issued in this area, including: U.S. Pat. Nos. 4,782,671; 4,926,646; 5,396,206; 5,442,928; 5,461,873; 5,485,730; 5,613,367; 5,623,240; 5,701,744; 5,782,095; and 5,848,532.

Still other known systems are based on magneto caloric effect, such as U.S. Pat. No. 4,599,866, or cyclically concentrating and diluting the amount of isotope $^3$He in a $^3$He—$^4$He solution, such as that disclosed in U.S. Pat. No. 5,172,554.

Moreover, the prior art, although addressing the need for cryocooling, has not solved the problem of achieving a more efficient cryocooler which provides high levels of refrigeration at relatively low cost.

BRIEF SUMMARY OF THE INVENTION

The present invention is a refrigeration method and apparatus for supplying refrigeration to a heat exchanger whereby refrigeration can be transferred from the heat exchanger to an external heat load such as the coil of a superconducting magnet or transformer.

Therefore, one aspect of the present invention is an apparatus for supplying refrigeration to an external heat source comprising, in combination, a first compressor for compressing a returning warmed cryogenic fluid stream to form a compressed stream; a heat exchanger for receiving and cooling the compressed stream by heat exchange with a returning stream used to form the returning warmed cryogenic fluid stream; means in the heat exchanger to separate the compressed stream into a major stream exiting the heat exchanger and a minor stream exiting the heat exchanger; an expander for expanding the major stream together with means to return an expanded major stream to the heat exchanger; means to expand the minor stream exiting the heat exchanger to further cool the minor stream; heat exchange means to use the minor stream to provide refrigeration to an external heat load; means to compress the minor stream after heat exchange with the external heat load and return the minor stream to the heat exchanger; and means to combine the major stream and the minor stream to form the returning warmed cryogenic fluid stream.

According to one preferred embodiment of the present invention, the heat exchange means used to provide refrigeration to the external heat load is a vacuum refrigerator which allows thermal contact between the working fluid of the refrigeration cycle and the external heat source. Alternatively, the working fluid in the refrigeration cycle can be the same fluid as that contained in a bath used to cool an external heat source. In this later embodiment, the cooling cycle is the same as described above but involves the reliquefaction of the vaporized coolant. The coolant, in this embodiment, absorbs heat as a liquid, is vaporized, is run through the cycle to be reliquefied, and is then returned to the cooling bath as a cold liquid.

Another aspect of the present invention is a method of supplying refrigeration to an external heat source comprising the steps of compressing a warmed return cryogenic fluid stream to form a compressed refrigerant stream; passing the compressed refrigerant stream into a heat exchanger for cooling by heat exchange with returning refrigerant; dividing the refrigerant stream into a major stream and a minor stream as it passes through the heat exchanger; taking the major stream from the heat exchanger and expanding the major stream to further cool the major stream prior to using the major stream as a heat exchange fluid for cooling the compressed refrigerant stream, taking the minor stream and expanding it to further cool the minor stream and using the minor stream to provide refrigeration to the heat load; and thereafter compressing the minor stream; and combining the compressed minor stream and the major stream at one of, before, during or after using the major stream and the minor stream in the heat exchanger to cool the compressed refrigerant stream, the combined major and minor streams after heat exchange forming the warmed return cryogenic fluid stream.

DETAILED DESCRIPTION OF THE INVENTION

Figure 1:
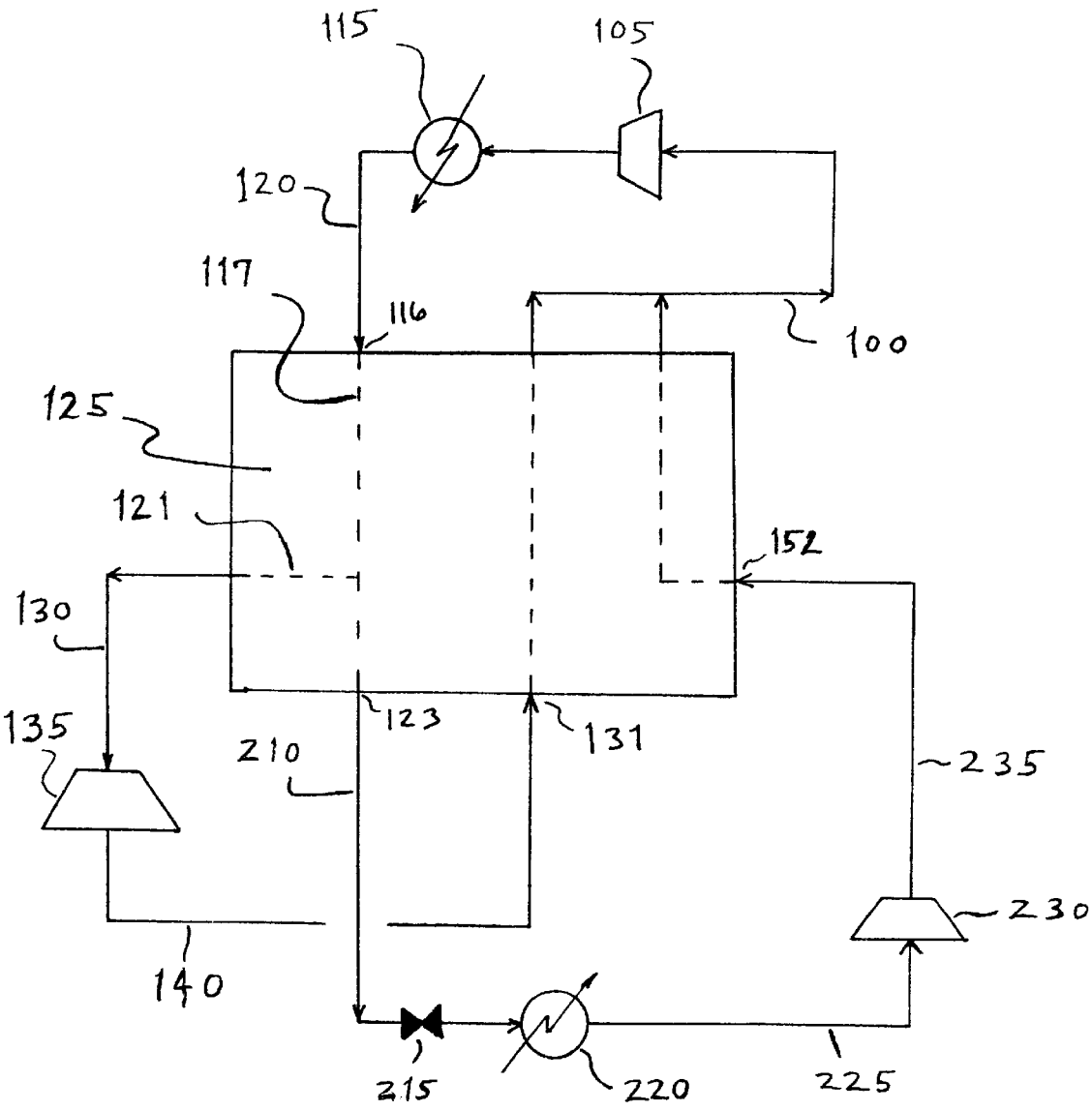
FIG. 1 is a schematic illustration of one embodiment of the present invention.

The present invention provides an efficient cryocooler system that provides high levels of refrigeration at low cost relative to known prior art methods and systems. The current system supplies refrigeration to an external heat load and comprises means to cool an external heat load, preferably a vacuum refrigerator, for allowing thermal contact between a cryogenic fluid and the external heat source for which cooling is desired. The system includes an expander and a main heat exchanger. The main heat exchanger has a warm side input and a cold side output connected by a refrigeration line for removing heat from the cryogenic fluid upstream from the means to cool the external heat load. The main heat exchanger also incorporates a bypass loop which removes part of the cryogenic fluid from the refrigeration line as a bypass stream between the warm side input and the cold side output.

The bypass loop is configured to transport the bypass stream through a bypass loop expander outside of the main heat exchanger and then back into the main heat exchanger at a first cold side input. The main heat exchanger has at least one cold side input and at least one warm side output, as well as, optionally, a second cold side input and optionally a second warm side output. The first warm side output is fluidly connected to the first cold side input via the bypass loop expander.

Just upstream of the means to cool the external heat load (preferably by a vacuum refrigerator), the pressure of the cryogenic fluid is reduced, preferably a Joule-Thomson valve, to further decrease its temperature. Between the means to cool the external heat load and the main heat exchanger is a cold compressor for compressing the cryogenic fluid after the cryogenic fluid receives heat from the external heat load. Also included in the system is a warm compressor for compressing the cryogenic fluid received from the main heat exchanger. The warm compressor receives its input from the warm side output(s) of the main heat exchanger. From the warm compressor the cryogenic fluid is circulated back to the main heat exchanger. Optionally, an aftercooler may be placed between the warm compressor and the main heat exchanger. The cycle of the system is continuous and refrigeration is continually supplied to the external heat source.

The individual components are well known to those skilled in the art. For example, each device to reduce the pressure of a fluid, whether it is a centrifugal expander or JT valve, can be sized by one skilled in the art depending on the particular application and thermodynamic properties of the other components used. This is true also for the compressors, heat exchangers, and piping.

Any appropriate cryogenic fluid can be used in the current invention, but the preferred fluids include nitrogen, oxygen, argon, helium, neon, krypton, freon, nitrogen trifluoride ($NF_3$) and combinations thereof.

In one particular embodiment of the present invention, no vacuum refrigerator is used, but rather a cooling bath is used to supply refrigeration to an external heat source. In such a case, the bath fluid may be the same as the working fluid in the refrigeration cycle. Typically in this case, the bath fluid absorbs heat from the external source, is vaporized and sent into the cooling cycle to be returned to the bath as a cold liquid.

The invention also provides a method of supplying refrigeration to an external heat source. The method comprises the steps of compressing a cryogenic fluid in a warm compressor and passing the cryogenic fluid through a cooling side of a heat exchanger to cool the cryogenic fluid to a cryogenic temperature. Within the heat exchanger, a major and minor stream are formed from the cryogenic fluid passing through the cooling side. The major stream is pulled out of the heat exchanger and transported through an expander to cool the major stream. The cryogenic fluid in the minor stream is used to provide refrigeration to an external heat source for which cooling is desired. Heat is absorbed from the external heat source and the cryogenic fluid in the minor stream is compressed in a cold compressor. Then, the cryogenic fluid in both the major stream and minor stream are passed through the second heat exchanger to cool the cryogenic fluid passing through the second heat exchanger on the cooling side. The cryogenic fluid of the major stream and the minor stream are combined, either before entry into, during passage through, or after exit from, the heat exchanger and passed to the inlet of the warm compressor and the cycle continues.

Reference is now made to FIG. 1 which illustrates the method and apparatus or system of the invention. The system 10 includes a main heat exchanger 125 disposed downstream of warm compressor 105 which receives a returning warmed cryogenic fluid shown as stream 100. Cryogenic fluid in stream 100 is compressed to form stream 120 which enters heat exchanger 125 at first warm side input 116. The fluid exiting compressor 105 may optionally pass through aftercooler 115 prior to entering heat exchanger 125. Aftercooler 115 can receive cooling from an external source. e.g. air or water. Once in heat exchanger 125, the cryogenic fluid of stream 120 passes through refrigeration line or passage 117 and is thereby cooled against at least one cooling stream, the details of which are discussed below.

As stream 120 passes through refrigeration line 117, at a pre-determined point in heat exchanger 125, stream 120 is split to form a major stream 130 which travels in bypass loop 121 in heat exchanger 125, and minor stream 210 which continues through heat exchanger 125 along refrigeration line 117 and leaves heat exchanger 125 at first cold side output 123. Major stream 130 contains a majority of the volume of cryogenic fluid from stream 120. Bypass loop 121 carries major stream 130 through expander 135, which is outside of heat exchanger 125, the output from expander 135 being expanded major stream 140. Expanded major stream 140 is then returned to heat exchanger 125 at a first cold side input 131. Alternatively, expanded major stream 140 could be combined with compressed minor stream 235 outside of heat exchanger 125, as shown schematically in FIG. 2.

Referring back to FIG. 1, minor stream 210 continues forward to vacuum refrigerator 220. Minor steam 210 exiting heat exchanger 125 is passed through a Joule-Thomson (JT) valve 215 and then to vacuum refrigerator 220. Vacuum refrigerator 220 is used to cool an outside heat load. In other words, the outside load is a heat source which is cooled by thermal contact with minor stream 210 in vacuum refrigerator 220. This outside load could be from any number of different applications, including cooling fluids used in superconductors, power transformers, magnetic resonance imaging, cryo surgery, or any other such cryogenic application.

The vacuum refrigerator can take the form of any of a number of forms known to those skilled in the art. Generally, any means for allowing heat transfer from the external heat source to the cycle will suffice.

After being warmed in vacuum refrigerator 220, the warmed cryogenic fluid in minor stream 225 is conducted to cold compressor 230 where it is compressed and further warmed to form compressed minor stream 235. Compressed minor stream 235 is then passed into heat exchanger 125 at second cold side input 152. Compressed minor stream 235 and expanded major stream 140 are further warmed by heat exchange with fluid in line 117 within heat exchanger 125. Compressed minor stream 235 and expanded major stream 140 are then joined back together outside of heat exchanger 125 to form returning warmed cryogenic fluid stream 100 which is then fed back to the inlet of warm compressor 105. This cycle continues as long as refrigeration for an external heat load is needed.

An exemplary operation of the system in FIG. 1 will now be discussed. A typical flow rate of cryogenic fluid (in this example, nitrogen) is about expander 140 lb moles/hour. Returning warmed inlet stream 100 would contain 140 lb moles/hour nitrogen at 85° F. and 16.5 psia. After passing through warm compressor 105 and optional aftercooler 115, stream 120 consists of 140 lb moles/hr nitrogen at 90° F. and 112.5 psia, when it enters heat exchanger 125. Within heat exchanger 125, refrigeration line 117 diverges to form major stream 130 and minor stream 210. Major stream 130 leaves heat exchanger 125 carrying 127.4 lb mole/hr nitrogen at −250° F. and 112 psia. Minor stream 210 leaves heat exchanger 125 carrying 20.6 lb moles/hr nitrogen at −289° F. and 112 psia. Thus, about 91% of stream 120 is pulled off as major stream 130 in bypass loop 121.

After passing through JT valve 215, the stream 210 is at 112 psia and −345° F. It then travels to heat exchanger 220 where it delivers refrigeration to an external load. Stream 225 leaves heat exchanger (e.g. vacuum refrigerator) 220 carrying 20.6 lb moles/hr nitrogen at −345° F. and 2 psia. Stream 235 is the result of the compression of stream 225 in cold compressor 230. Stream 235 exits cold compressor 230 at 20.6 lb moles/hr nitrogen at −219° F. and 16.6 psia.

Stream 235 enters heat exchanger 125 at second cold side input 152 and rejoins expanded major stream 140 to form returning warmed inlet stream 100 comprising 140 lb moles/hr at 35° F. and 16.5 psia. The cycle then continues.

Figure 2:
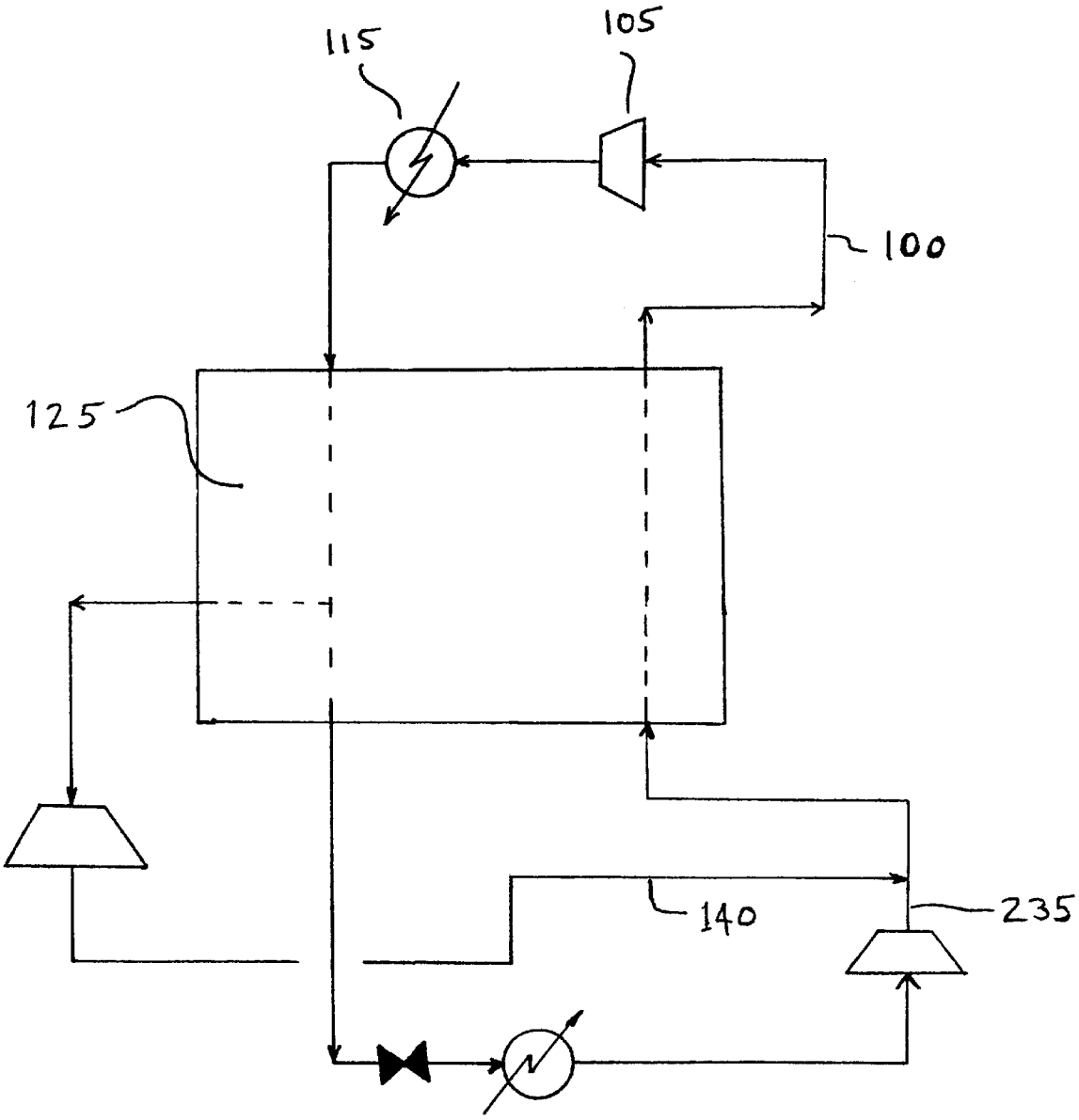
FIG. 2 is a schematic illustration of another embodiment of the present invention.

Alternative embodiments that are within the scope of this invention may be envisioned by one skilled in the art. For example, FIG. 2 shows an embodiment where expanded major stream 140 is reunited with compressed minor stream 235 prior to reentry into heat exchanger 125 as a single stream.

Figure 3:
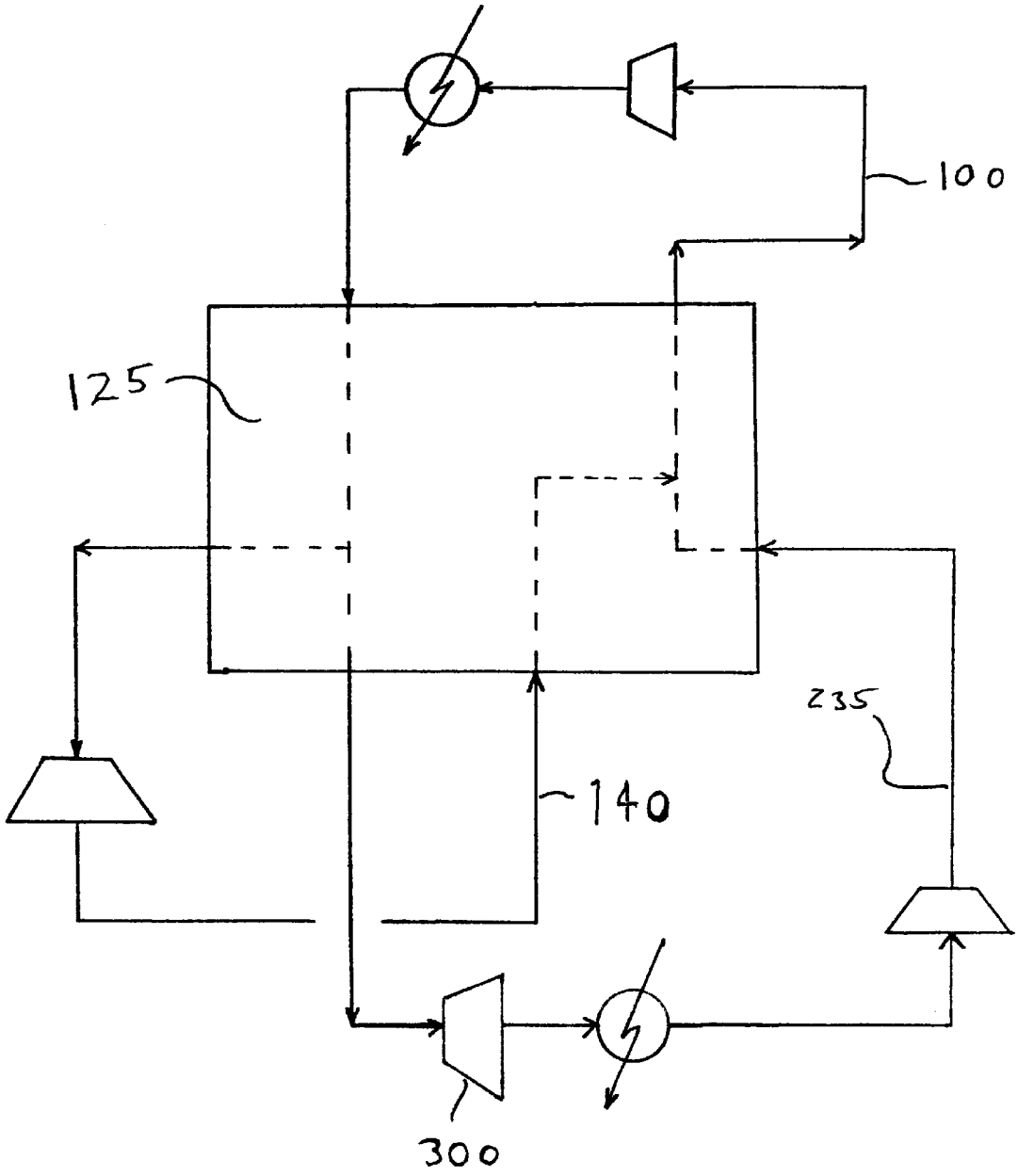
FIG. 3 is a schematic illustration of yet another embodiment of the present invention.

FIG. 3 shows another variation in which cooled major stream 210 is expanded in expander 300 instead of a JT valve. In each case, appropriate modifications to thermodynamic performance would have to be considered in order to achieve the results desired.

Figure 4:
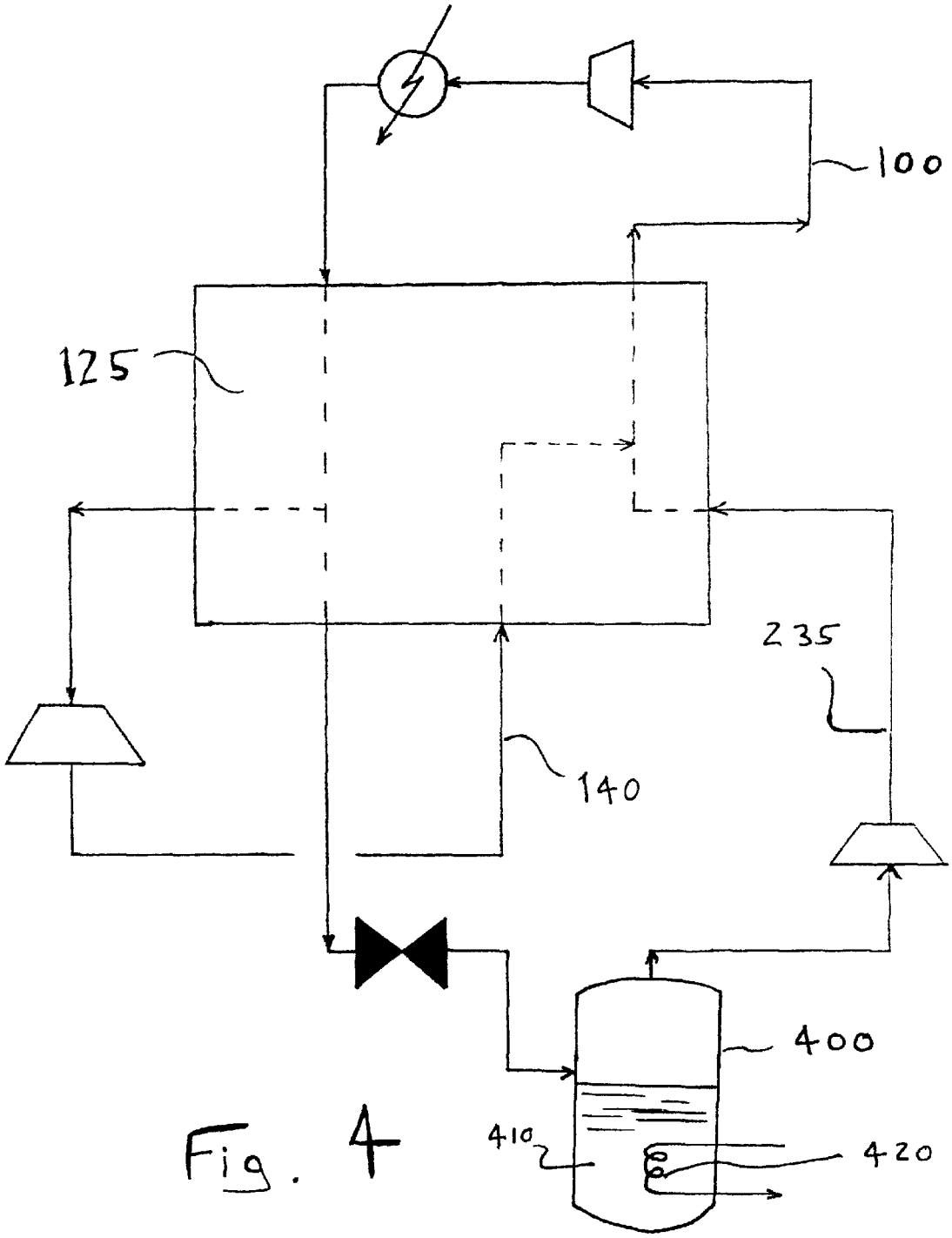
FIG. 4 is a schematic illustration of an embodiment of the present invention where the coolant bath fluid is the same as the working fluid in the cycle.

Also, and as discussed above, the cycle may use a refrigeration bath to allow refrigeration to be delivered to an external heat source via heat exchange. As shown schematically in FIG. 4, no vacuum refrigerator is used, but rather vessel 400 holding a bath, or volume cryogenic fluid 410 is utilized. Known means, e.g. a fluid circulating in a tubular heat exchange coil 420, can be used for thermal contact between the liquid cryogenic fluid 410 and the external heat source (not shown). In this embodiment, vaporized liquid cryogenic fluid from bath 410 is collected in the top of vessel 400. Vaporized cryogenic fluid from vessel 400 is compressed in compressor 230 to form stream 235 which is combined with major stream 140 and warmed in heat exchanger 125 to form returning warmed inlet stream 100.

The present invention has been set forth with regard to several preferred embodiments, but the full scope of the invention should be ascertained by the claims that follow.

What is claimed is:

1. A refrigeration system comprising in combination:

a first compressor for compressing a returning warmed cryogenic fluid stream to form a compressed stream;

a heat exchanger for receiving and cooling said compressed stream by heat exchange with a returning stream used to form said returning warmed cryogenic fluid stream;

means in said heat exchanger to separate said compressed stream into a major stream exiting said heat exchanger and a minor stream exiting said heat exchanger;

an expander for expanding said major stream together with means to return an expanded major stream to said heat exchanger;

means to expand said minor stream exiting said heat exchanger to further cool said minor stream;

heat exchange means to use said minor-stream to provide refrigeration to an external heat load;

means to compress said minor stream after heat exchange with said external heat load and return said minor stream to said heat exchanger; and means to combine said major stream and said minor stream to form said returning warmed cryogenic fluid stream.

2. The system of claim 1 wherein said means to expand said minor stream is a Joule-Thomson valve.

3. The system of claim 1 wherein said heat exchange means is a vacuum refrigerator.

4. The system of claim 1 further comprising an aftercooler between said first compressor and said heat exchanger.

5. The system of claim 1 wherein said heat exchanger cools said compressed cryogenic stream to a below cryogenic temperature.

6. The system of claim 1 wherein said means to combine said major and minor streams combines said streams outside of said heat exchanger.

7. The system of claim 1 wherein said means to combine said major and minor streams combine said streams inside of said heat exchanger.

8. The system of claim 1 wherein said means to combine said major and minor streams combine said streams after exiting said heat exchanger.

9. The system of claim 1 wherein said heat exchange means include a vacuum refrigerator.

10. The system of claim 1 wherein said heat exchange means includes a bath of liquid cryogen created by liquefaction of said minor stream.

11. The system of claim 1 wherein said cryogenic fluid is selected from the group consisting of nitrogen, oxygen, argon, helium, neon, krypton, freon, $NF_3$ and combinations thereof.

12. The system of claim 1 further comprising an aftercooler between said compressor and said heat exchanger for cooling said cryogenic fluid to above ambient temperature.

13. The system of claim 1 wherein said heat exchanger cools said cryogenic fluid to a cryogenic temperature.

14. The system of claim 1 wherein said major stream leaves said heat exchanger at a cryogenic temperature and is further cooled by said expander.

15. The system of claim 1 wherein said major stream leaves said heat exchanger at above cryogenic temperature and is further cooled by said expander.

16. The system of claim 1 wherein said major stream leaves said heat exchanger at below ambient temperature and is further cooled by said expander.

17. A method for producing refrigeration in a closed cycle for application to a heat load comprising the steps of:

compressing a warmed return cryogenic fluid stream to form a compressed refrigerant stream;

passing said compressed refrigerant stream into a heat exchanger for cooling by heat exchange with returning refrigerant;

dividing said refrigerant stream into a major stream and a minor stream as it passes through said heat exchanger;

taking said major stream from said heat exchanger and expanding said major stream to further cool said major stream prior to using said major stream as a heat exchange fluid for cooling said compressed refrigerant stream, taking said minor stream and expanding it to further cool said minor stream and using said minor stream to provide refrigeration to said heat load; and thereafter compressing said minor stream; and combining said compressed minor stream and said major stream at one of, before, during or after using said major stream and said minor stream in said heat exchanger to cool said compressed refrigerant stream, said combined major and minor streams after heat exchange forming said warmed return cryogenic fluid stream.

18. The method of claim 17 including the step of expanding said minor stream in a Joule-Thomson valve.

19. The method of claim 17 including the step of rejoining said major and minor streams outside of said heat exchanger.

20. The method of claim 17 including the step of rejoining said major and minor streams inside of said heat exchanger.

21. The method of claim 17 including the step of forming a major and minor stream from said compressed refrigerant fluid as it passes through a cooling side of said heat exchanger.

22. The method of claim 17 including the step of selecting said warmed return cryogenic fluid from the group consisting of nitrogen, oxygen, argon, helium, neon, krypton, freon, $NF_3$ and combinations thereof.

23. The method of claim 17 including the step of passing said compressed refrigerant stream through an aftercooler between said compressor and said heat exchanger for cooling said refrigerant stream to an above ambient temperature.

24. The method of claim 17 including the step of using said heat exchanger to cool said compressed refrigerant stream to a below cryogenic temperature.

25. The method of claim 17 including the steps of withdrawing said major stream from said heat exchanger at a below cryogenic temperature and further cooling said major stream through said expander.

26. The method of claim 17 including the step of withdrawing said major stream from said heat exchanger at an above cryogenic temperature and further cooling said major stream through said expander.

27. The method of claim 17 including the step of withdrawing said major stream from said heat exchanger at a below ambient temperature and further cooling said major stream through said expander.

* * * * *